US009493288B2

(12) United States Patent
Skiffington et al.

(10) Patent No.: US 9,493,288 B2
(45) Date of Patent: Nov. 15, 2016

(54) RESEALABLE MOISTURE TIGHT CONTAINERS

(75) Inventors: Richard T. Skiffington, North Reading, MA (US); James Farago, Salisbury, MA (US)

(73) Assignee: Charm Sciences, Inc., Lawrence, MA (US)

( * ) Notice: Subject to any disclaimer, the term of this patent is extended or adjusted under 35 U.S.C. 154(b) by 756 days.

(21) Appl. No.: 12/445,418

(22) PCT Filed: Nov. 7, 2007

(86) PCT No.: PCT/US2007/023380

§ 371 (c)(1),
(2), (4) Date: Apr. 13, 2009

(87) PCT Pub. No.: WO2008/057541

PCT Pub. Date: May 15, 2008

(65) Prior Publication Data

US 2010/0043359 A1 Feb. 25, 2010

Related U.S. Application Data

(60) Provisional application No. 60/857,375, filed on Nov. 7, 2006.

(51) Int. Cl.
*B67B 1/03* (2006.01)
*B65D 83/00* (2006.01)

(52) U.S. Cl.
CPC ..... *B65D 83/0011* (2013.01)

(58) Field of Classification Search
CPC ..... B65D 83/0011
USPC ..... 53/290, 266.1, 281, 167, 141, 130.1, 53/471
See application file for complete search history.

(56) References Cited

U.S. PATENT DOCUMENTS

| | | | | | |
|---|---|---|---|---|---|
| 3,363,305 | A | * | 1/1968 | Botkin | 29/458 |
| 3,467,569 | A | * | 9/1969 | Weber et al. | 428/317.7 |
| 3,509,991 | A | * | 5/1970 | Hurst | 428/322.7 |
| 3,682,764 | A | * | 8/1972 | Findlay et al. | 428/317.7 |
| 3,739,976 | A | * | 6/1973 | MacDaniel | 220/780 |
| 3,786,954 | A | * | 1/1974 | Shull | 215/341 |
| 3,819,460 | A | * | 6/1974 | Dukess | 428/66.4 |
| 3,917,100 | A | * | 11/1975 | Dukess | 215/329 |
| 3,963,845 | A | * | 6/1976 | Dukess | 428/66.4 |
| 3,976,217 | A | * | 8/1976 | Dukess | 215/329 |
| 3,995,087 | A | * | 11/1976 | Desanzo | 428/41.3 |
| 4,121,728 | A | * | 10/1978 | Tagalakis et al. | 215/260 |
| 4,133,447 | A | * | 1/1979 | Bouchet | 220/258.3 |

(Continued)

FOREIGN PATENT DOCUMENTS

GB 738718 A 6/1956

*Primary Examiner* — Sameh Tawfik
(74) *Attorney, Agent, or Firm* — MacCord Mason PLLC; Richard J. Long

(57) ABSTRACT

A substantially moisture-tight unit for packaging moisture-sensitive items. The unit includes a container and cap. The container has a closed container bottom, a container top, a sidewall extending upwardly from the container bottom to the container top and a fixed surface at, or near, the container top. The unit also includes a cap. The cap has a lid and a moisture impervious layer attached to an inside portion of the lid. The lid can snap onto the container to hold the moisture impervious layer against a fixed surface forming a moisture barrier.

15 Claims, 16 Drawing Sheets

(56) References Cited

U.S. PATENT DOCUMENTS

| | | | | | |
|---|---|---|---|---|---|
| 4,225,553 | A | | 9/1980 | Hirota | |
| 4,431,111 | A | | 2/1984 | Prohaska | |
| 4,474,304 | A | * | 10/1984 | Jacobs | 220/276 |
| 4,500,010 | A | * | 2/1985 | Schutz | 220/320 |
| 4,818,577 | A | | 4/1989 | Ou-Yang | |
| 5,251,460 | A | | 10/1993 | DeMarco | |
| 5,592,766 | A | * | 1/1997 | Mygatt | 40/307 |
| 6,544,613 | B1 | * | 4/2003 | Varadarajan | 428/36.9 |
| 2001/0047977 | A1 | | 12/2001 | Forman | |
| 2005/0172832 | A1 | | 8/2005 | Groenke | |

* cited by examiner

RESEALABLE MOISTURE TIGHT CONTAINERS

REFERENCE TO PRIOR APPLICATIONS

The present application claims the benefit of U.S. Provisional Application Ser. No. 60/857,375, filed Nov. 7, 2006, the contents of which are incorporated herein by reference in its entirety.

BACKGROUND

It is important that containers for moisture sensitive and/or oxygen sensitive items be well sealed to provide maximum shelf-life. It is also important that such sealed containers are provided at low cost. We describe herein a moisture tight, relatively low cost container and cap combination for a variety of moisture and/or oxygen sensitive goods.

SUMMARY

Some aspects include a substantially moisture tight unit for packaging moisture-sensitive items. Such a test unit will have a low moisture vapor transmission rate and/or a low moisture vapor and oxygen transmission rate. The unit may include: a container, the container having a closed container bottom, a container top, a sidewall extending upwardly from the container bottom to the container top and a fixed surface at, or near, the container top; and a cap, the cap having a lid and a moisture impervious layer attached to the inside of the lid, the lid capable of forming a seal with the container top, the moisture impervious layer situated so that when the lid forms a seal with the container top the moisture impervious layer contacts the fixed surface to form a moisture barrier. The lid can have a gasket situated between the lid and the moisture impervious layer. The gasket can be composed of a compressible member having a top attached to the inside of the lid and a bottom attached to a moisture impervious layer. The compressible member can have a low moisture transmission rate and, therefore, in some embodiments, an additional moisture impervious layer may not be required. That is, the compressible member serves as the moisture impervious layer. The compressible member can be a foam or foam-like material such as a quick recovery, resilient, polyurethane foam. The moisture impervious layer can be attached to the gasket and can be composed of metallic foil membrane material, for example a wrinkle-free foil material attached to a compressible member. The gasket can also be in the form of one or more raised rings of material extending downwardly from the inside portion of the lid and attached to the moisture impervious layer. The raised rings can be molded plastic and can be molded into a plastic lid or be attached to a lid. The lid can be in the form of an over cap, for example a snap-on cap such as those typically found, for example, on cans of nuts. Similar such over caps are those described in U.S. Pat. No. 7,165,306, issued Jan. 23, 2007 (Overcap Having Improved Fit), hereby incorporated by reference.

The container can include a variety of materials and be in a variety of shapes and configurations. One example includes a foiled lined paper composite can.

Some aspects include a method of packaging moisture sensitive material. The method includes: placing the material within a container having a closed container bottom, a container top, a sidewall extending upwardly from the container bottom to the container top and a fixed surface at, or near, the container top; and contacting the fixed surface with a moisture impervious layer, the moisture impervious layer attached to a lid capable of forming a seal with the fixed surface, the lid having an inside lid and outside lid, the moisture impervious layer situated so that when the lid forms a seal with the fixed surface the moisture impervious layer contacts the fixed surface to form a moisture barrier. The moisture impervious layer can be attached to a gasket. The gasket can include a compressible member having a top attached to the inside of the lid and a bottom attached to the moisture impervious layer. The compressible member can also have a low moisture transmission rate so to avoid the necessity of using an additional moisture impervious layer. The compressible member can be a resilient, quick-recovery, polyurethane foam material. The moisture impervious layer material can be a wrinkle-free metallic foil material. Rather than using a foam-like material the method can include, as the gasket, one or more raised rings of material, molded as part of the cap or attached to the cap and extending downwardly from the inside of the lid and attached to the moisture impervious layer.

DESCRIPTION

Figure 1:
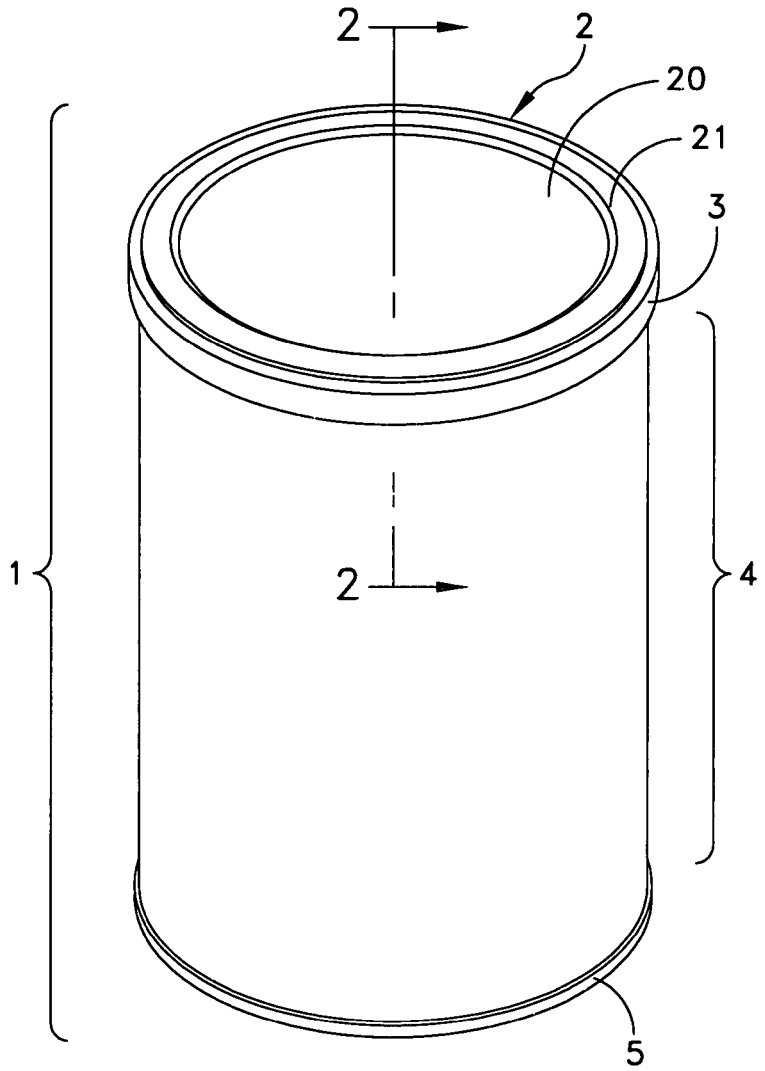
FIG. 1 is an isometric view of a container and cap with cap on container prior to use.

We describe herein various embodiments for storing and packaging moisture-sensitive items such as edible items, for example baby formula, oatmeal, coffee, nuts and the like, diagnostic reagents, diagnostic test strips and pharmaceuticals. The embodiments include a container and cap combination. When the cap is secured in place on the container a moisture barrier is formed.

The container can have an opening, a closed container bottom, a container top and a sidewall extending upwardly from the container bottom to the container top. The container top can have a fixed surface that extends inwardly from the inner sidewall to frame the opening and permit access to the interior of the container where the contents will be stored. In an embodiment, the fixed surface extends inwardly far enough from the inner sidewall to provide a contact surface for adhering a removable material such as a membranous or foil material, and also to provide a surface for contact with a moisture impervious layer, such as described herein.

The container bottom can be closed by rolled, seamed and crimped steel, other metal or other material, such as plastic, that can provide a substantially or completely moisture tight seal against the container bottom.

The container sidewalls can be composed of a variety of materials capable of providing a substantially or totally moisture proof environment such as molded plastic, paper, or glass containers. For example, the container can be blow-molded.

In an embodiment the container is a composite can with a foil label inside and out, with dimensions of 401 (diameter) by 411 (length). In a particular example the body was a vinyl slipcoat/foil/kraft inner liner ply, heat sealed and with two plies of canboard and a water based acrylic/foil/kraft label as the outer ply. The container body can be in variety of shapes including rectangular, square and cylindrical, the shape of the body being compatible with the shape of the cap.

In an embodiment, the container top can be sealed with an ULTRASEAL (ULTRASEAL is a registered trademark of Sonoco Hartsville, S.C.) peelable membrane closure that initially covers the container opening. A variety of removable seals, such as peelable, tearable or cutable seals can be used such as those made of a variety of metals, aluminum, plastic, paper, or other membrane seals. Similar such seals are typically found covering consumer goods such as soup cans, coffee cans, nut cans and the like. In an embodiment, a peelable seal is provided adhered to a fixed surface at the top of a container and configured for easy removal. ULTRASEAL is a foil seal that has been found to be useful and has the advantage of having a smooth finish. Other foil seals, such as SEALEDSAFE seal (SEALEDSAFE is a registered trademark of Sonoco Hartsville, S.C.) can provide adequate moisture barrier properties but may not be adequate due to the rough, waffle-like texture of the finish which can create an imprint, particularly on foil material when such material is used as the moisture impervious layer. To avoid such an imprint, the cap can be delivered to the user on the bottom of the container. Once the roughly textured material is removed, prior to accessing the contents of the can, the cap can be removed from the container bottom and placed on the container top.

In an embodiment the opening at the top of the container is bounded by a lip, or ridge, that extends upwardly from the sidewall at the container top and also extends outwardly around the outer periphery of the top of the container. The inside wall at or just below the container top can also have a lip, or ridge, extending inwardly to form a fixed surface near the top of the container. The fixed surface can be a surface against which a removable cover, such as ULTRASEAL, can be sealed. The fixed surface can also be used as a surface against which a moisture impervious layer of a cap, described hereinafter, can form a moisture barrier. The dimensions of inwardly extending lip or ridge which forms the fixed surface must be sufficient to provide a surface against which the removable cover can seal and/or a surface against which the moisture impervious layer of the cap can seal.

The cap can have a lid and a moisture impervious layer. The lid can have an outer lip, or ridge, that extends downwardly, covering only a small portion of the sidewall, sometimes referred to as an over cap. As such, when the sidewall at the top of the container includes an outwardly extending lip, the lid portion can extend downwardly over the lip and snap-on the container. The lid portion can be composed of, for example, a standard plastic over-cap such as an over-cap made from low density polyethylene. Injection molding can be used to make the overcaps. Examples of containers on which these are used include paperboard containers having a plastic or metal rim (used, for example, with oatmeal or roasted nuts) and plastic tubs (used, for example, for soft cheeses and butter). The overcap can have a rounded ridge on the inside which snaps over the similar lip, or ridge, on the top of the sidewall of the container. The top of the overcap can have a generally flat upper surface with a ridge running near the outer edge to provide additional strength.

The moisture impervious layer provides the ability to reseal the container to substantially maintain the moisture-free environment after accessing the container contents. The moisture impervious layer can be attached to the cap, for example via a gasket. The gasket can be composed of a compressible member. The compressible member can have a top attached to the inside of the lid and a bottom extending downwardly from the inside of the lid. The compressible member can be configured, for example, to contact at least a portion of a fixed surface located at or near the top of the container. The compressible member can be of a variety of materials such as foam or foam-like material. One criterion for selecting appropriate compressible material can be low moisture vapor transmission rate properties. When the cap is correctly placed on the container, the compressible material can form a substantially moisture tight seal between the cap and the fixed surface. In one embodiment 3/16" foam is used. An example of useful foam material is PORON® (PORON is a registered trademark of World Properties Inc., Lincolnwood, Ill.) microcellular urethane foam. Other foam materials that can be useful include GASKA TAPE (GASKA TAPE is a registered trademark of Gaska Tape, Inc. Elkhurst, Ill.) PVC foam. A particularly useful property of some foam materials is the capacity of the material to return to its previous shape after deformation. Closed cell foam material has also been found to be useful.

Other possibly useful gasket materials include rubber and plastic materials. In some embodiments the gasket material can provide a moisture barrier and, therefore, serve as the moisture impervious layer. Alternatively, the gasket can include an additional layer of material, such as a material with a low moisture vapor transmission rate, attached to the bottom of the gasket. The moisture impervious layer can be of a variety of materials including metallic foil, plastic, paper laminates, or any other suitable material. The moisture impervious layer can be configured to contact a fixed surface at or near the top container surface when the cover is placed on the container. That is, instead of the compressible material contacting the fixed surface directly, the compressible material presses the moisture impervious layer against the fixed surface when the container cover is secured in place. The moisture impervious layer can provide a primary or secondary moisture barrier. A variety of materials may be suitable including foil, or foil-like material.

A possible problem with using foil material is wrinkling in the foil and the resulting leakage of air or moisture. As a result, a particularly desirable feature of whatever material is chosen is that the material is substantially or completely wrinkle-free. One example of a wrinkle-free foil material is ALCOA COLDFORM 3000 (ALCOA COLDFORM 3000 is a trademark of Aluminum Company of America, Pittsburgh, Pa.).

In another embodiment the moisture impervious layer is attached the cap portion by spring-like plastic members that are collapsible/compressible. The plastic material can be such that it compresses/collapses to seal the moisture impervious layer against the fixed surface and retains its strength through multiple removal and replacements of the cap. Possible advantages of the spring-like plastic as compared to the foam material include lower cost. The plastic can be in a variety of shapes such as pins, fins and the like.

In another embodiment, the moisture impervious layer is attached to one or more raised rings of material, such as plastic, that are either attached to or molded as part of the lid. The raised rings of material can be used as the gasket. The raised rings of material can extend downwardly from the inside of the lid and have the moisture impervious layer attached to them. A possible advantage of the ringed lid includes the efficiency of avoiding material to be attached to the lid such as layers of plastic or compressible material. The raised rings can be molded as part of the lid.

In another embodiment, rather than completely removing the removable covering the user can retain the removable covering for closure underneath the cap thereby providing an additional moisture barrier.

In an embodiment, the container is sealed, prior to use, with a desiccant or similar moisture absorbing material inside. Such material reduces the moisture present within the container when it is sealed and absorbs moisture entering the container when the cap is removed. Nitrogen purging can also be used, prior to sealing.

In another embodiment the cap and/or container includes a desiccant sealed therein. The desiccant can be entrained within a liner or sleeve such as a desiccant entrained plastic liner or sleeve. The desiccant can also within the material used for a gasket such as within the material composing a compressible member. Useful desiccants include silica gel and molecular sieve. Molecular sieve is particularly useful when the desired relative humidity is less than about 40%.

DETAILED DESCRIPTION OF THE FIGURES

The container and cap combination shown in FIG. 1 prevents the ingress of moisture both prior to first opening and after first opening. Container 1 has base 5 and sidewall 4. Base 5 can be rolled, crimped and sealed in place and can be made of steel, other metals, plastic or other moisture impervious material that can be sealed in place. Lid portion 2 of the cap has downwardly extending portion 3. Top of lid 2 has generally flat upper surface 20 and optional raised portion 21 around the outer edge to provide additional strength.

Figure 2:
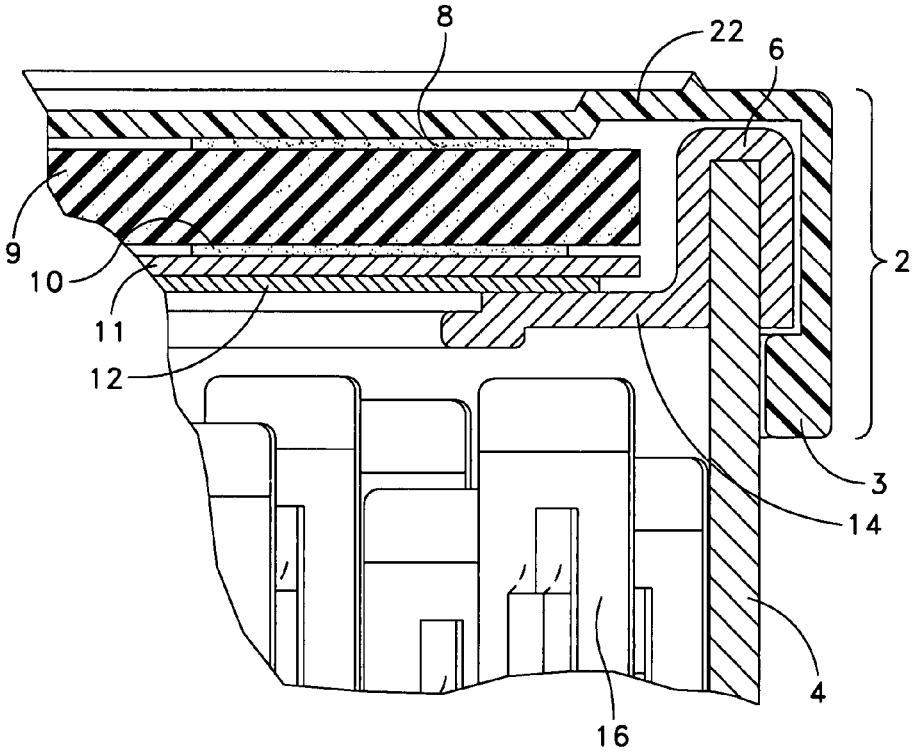
FIG. 2 is a cross-section of a container and cap with cap engaged on the container prior to first opening with test strips within the container.
Figure 3:
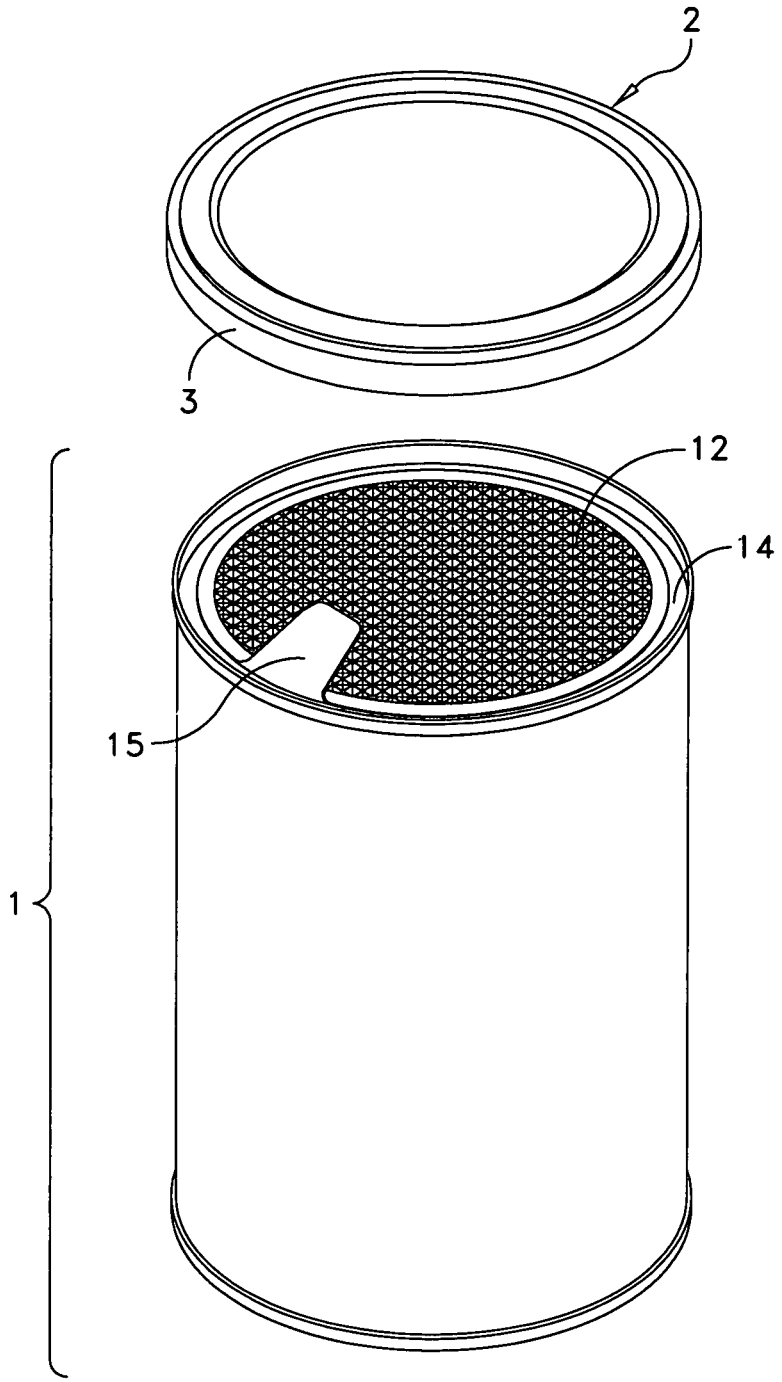
FIG. 3 is an exploded view of a cap removed from the container showing removable seal on the container.
Figure 4:
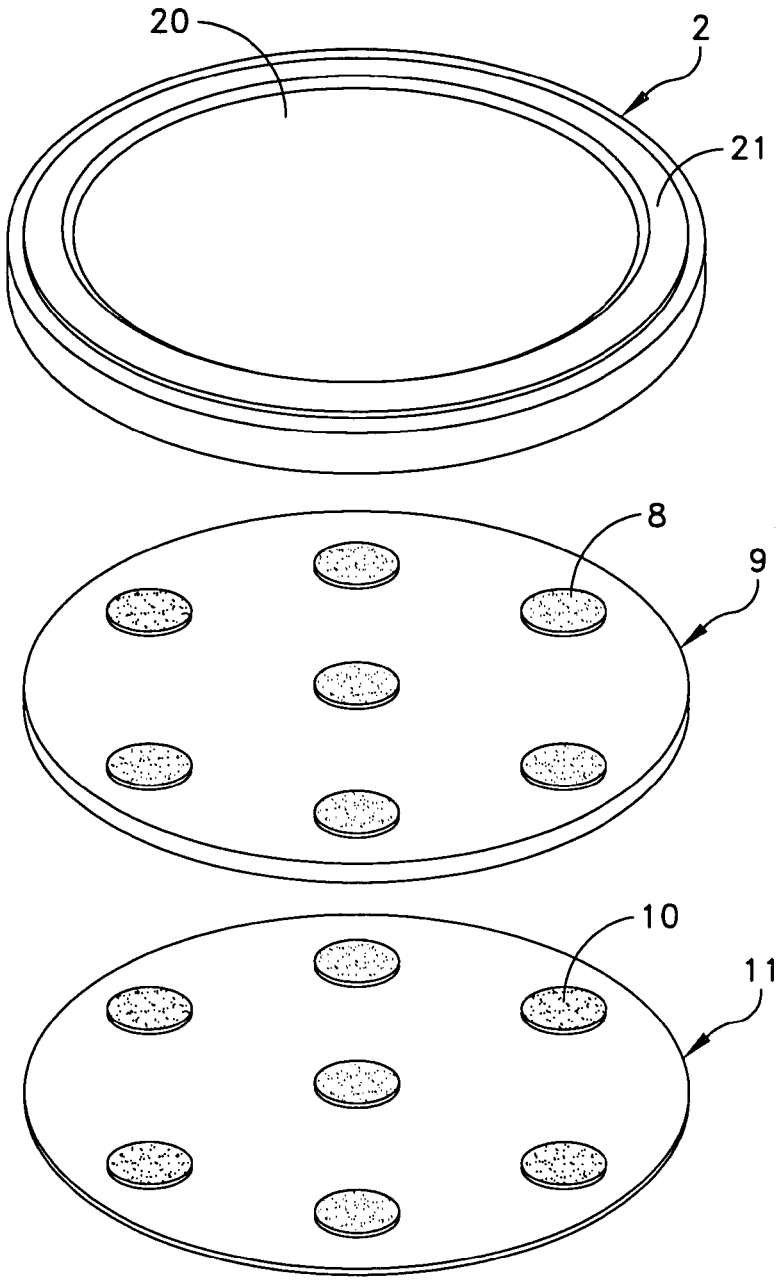
FIG. 4 is an exploded view of a cap showing a lid, and exploded gasket showing compressible material and moisture impervious additional barrier.
Figure 5:
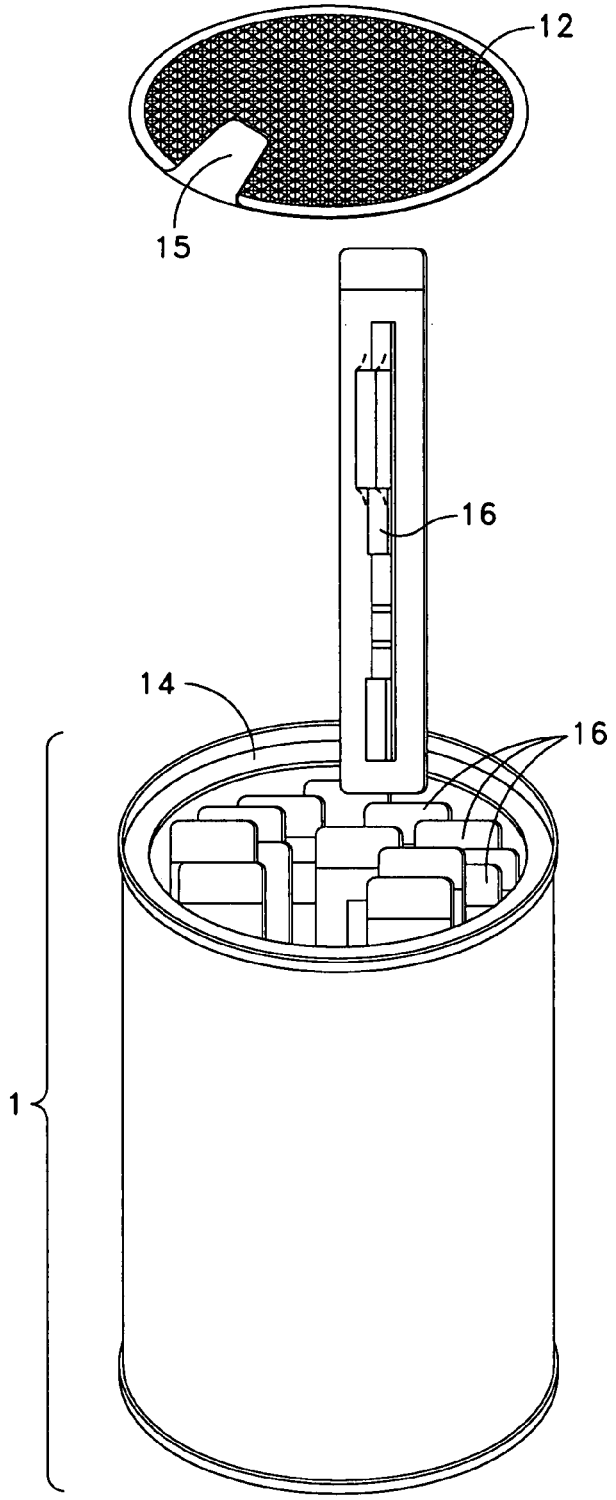
FIG. 5 is an exploded view of a container with seal removed and access to test strips within.

In an embodiment shown in FIG. 2, lid portion 2 of the cap has downwardly extending portion 3 that engages over lip 6 that extends outwardly (and downwardly) from sidewall 4. Two layers of adhesive are present. First adhesive layer 8 adheres compressible member 9 to lid portion 2 and second adhesive layer 10 adheres moisture impervious layer 11, which depending on the moisture barrier properties of the compressible member may or may not be required, to bottom of compressible member 9. Adhesive layers (8 & 10) are shown in FIG. 4 in a spaced apart configuration, however, the adhesive can also be spread sheet-like over the entire surface. Prior to first opening, removable seal 12 is present providing an additional moisture barrier and sealed against the inwardly extending fixed surface 14 near the top of the container. Removable seal 12 can have a textured surface, as shown in FIGS. 3 and 5, or, preferably, have a smooth surface. Within the container are test strips 16.

FIG. 3 shows an embodiment with cap 2 removed from the top of container 1 with the removable seal 12 sealed against fixed surface 14 near the top of container 1. Also shown is tab 15 for ease of tearing off removable seal 12 to access contents of container.

FIG. 4 is an exploded view of a cap showing lid 22, adhesive 8 to adhere compressible member 9 to lid 2 and adhesive 10 to adhere moisture impervious layer 11 to compressible member 9.

Figure 6:
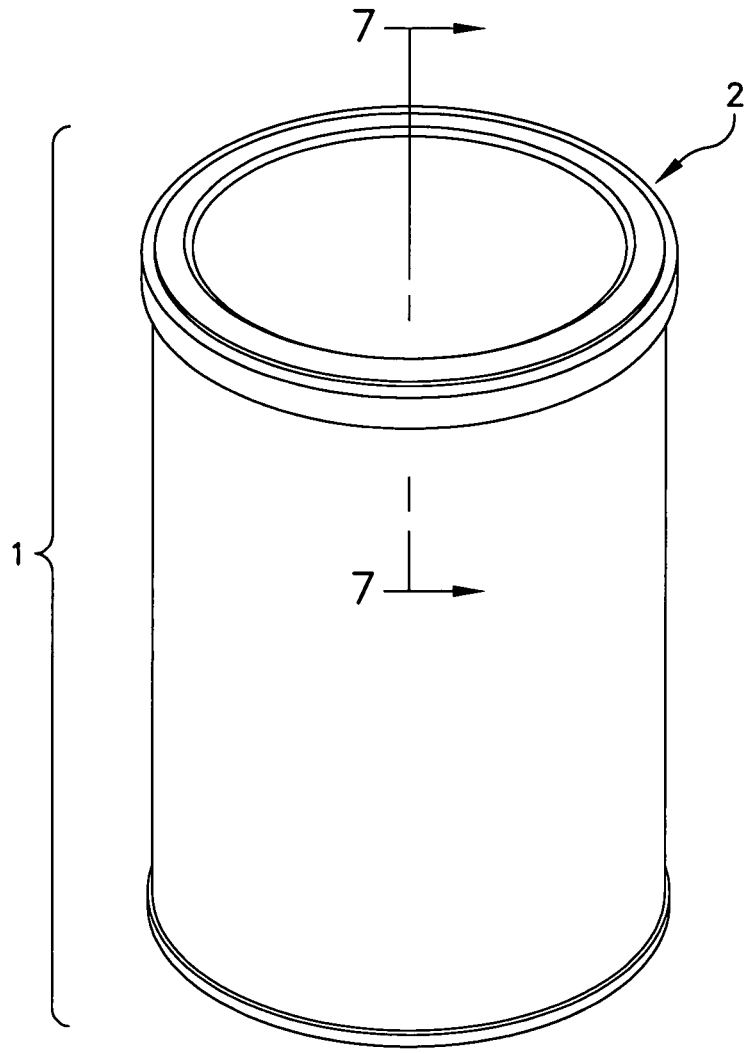
FIG. 6 is an isometric view of a cap replaced on top of a container after first use.
Figure 7:
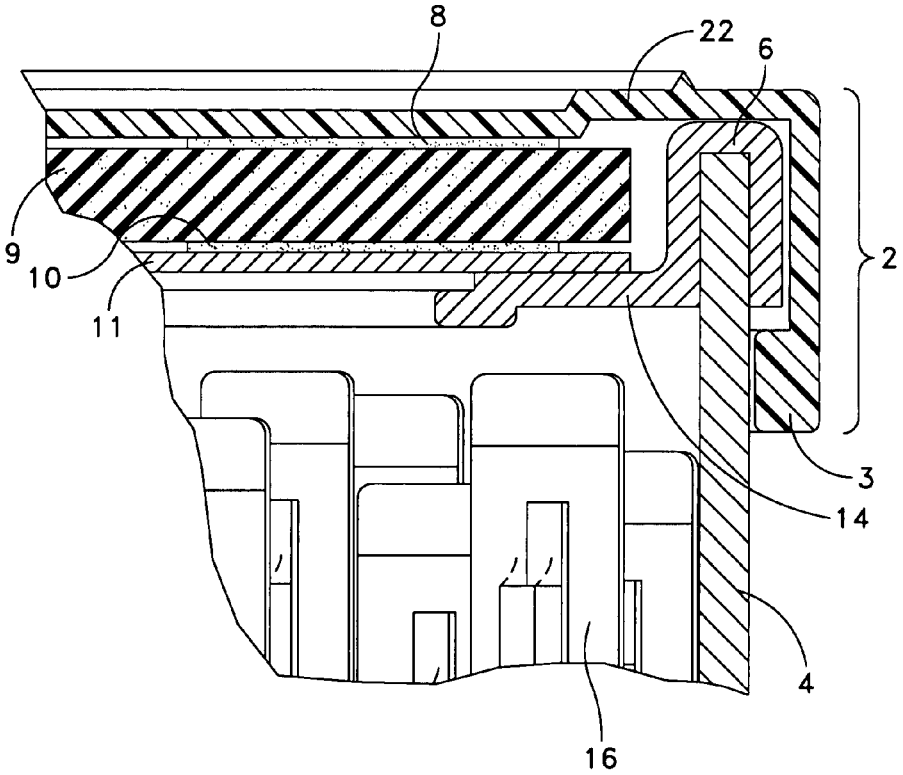
FIG. 7 is a cross-sectional view of a container and cap with cap re-engaged on top of container after first opening and test strips within.

FIG. 5 shows removable seal 12 removed from fixed surface 14 near the top of container 1 providing access to test strips 16 within container 1. FIGS. 6 and 7 show replacement of cap 2 replaced onto container 1 after opening container 1. When cap 2 is replaced onto container 1 compressible member 9 provides downward pressure so that moisture impervious layer 11 forms a substantially moisture proof seal against fixed surface 14.

Figure 8:
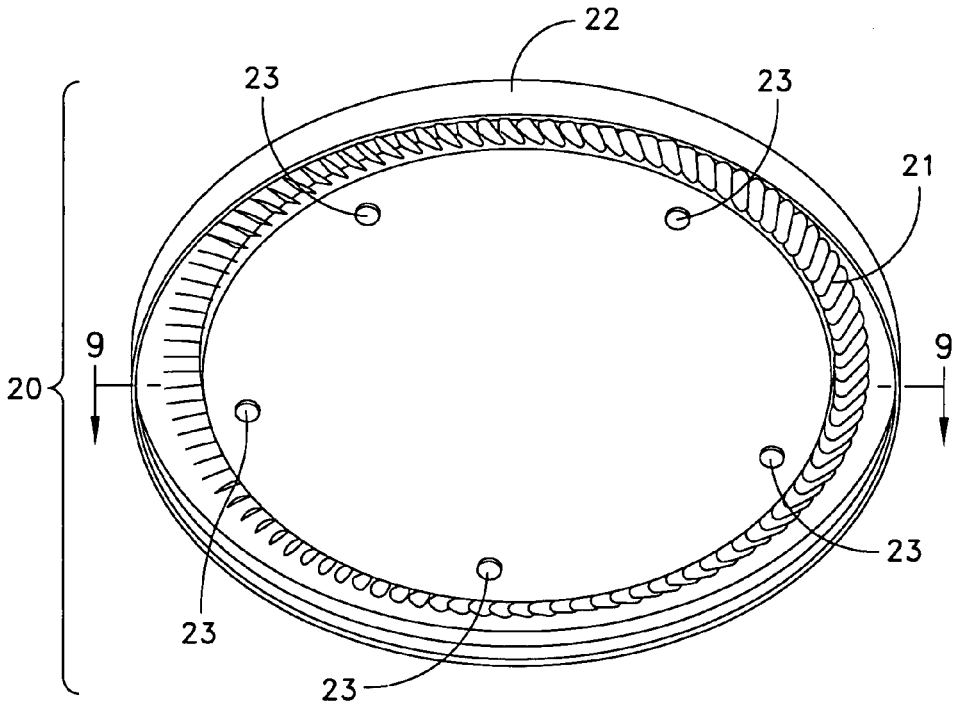
FIG. 8 is an isometric view of the underside of a cap with fins surrounding the inside periphery of a lid.

FIG. 8 shows another embodiment of a cap. Underside of cap 20 includes fins 21 surrounding the inside periphery of lid 22 and rivets 23 for use in attaching a moisture impervious layer to lid 22. When cap 20 is placed on a container, fins 21 compress against lid 22 while applying pressure to seal a moisture impervious layer against a fixed surface such as a surface that surrounds the top of a container opening.

Figure 9:
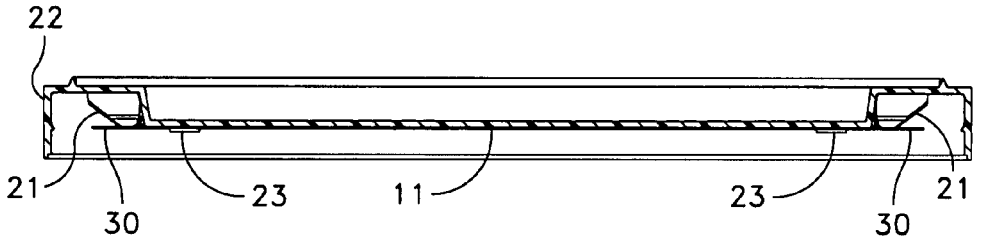
FIG. 9 is a cross-section of cap showing a moisture impervious layer attached to a lid, through rivets, and fins attaching loose edges of moisture impervious layer to a lid which is sealed against a fixed surface.

In FIG. 9 fins 21 hold loose ends 30 of moisture impervious layer 11. Fins 21 are compressed slightly putting pressure on moisture impervious layer 11 so that it forms a moisture barrier with fixed surface 14 near the top of the container.

Figure 10:
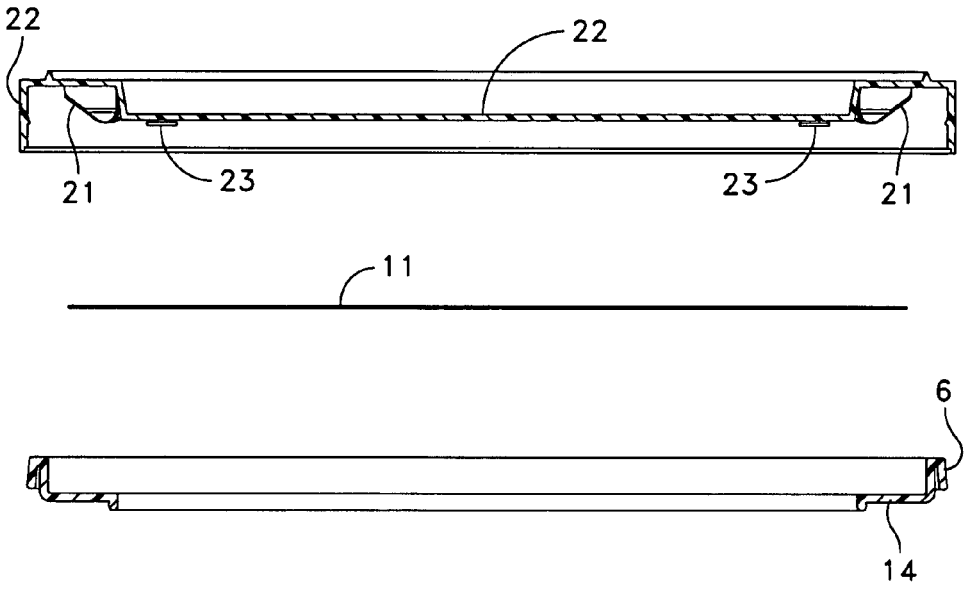
FIG. 10 is an exploded cross-section of a cap showing lid with attached fins and moisture impervious layer.

FIG. 10 is an exploded cross-section showing lid 22 with attached fins 21, rivets 23, moisture impervious layer 11 and section of a container top with fixed surface 14 and container lip 6.

Figure 11:
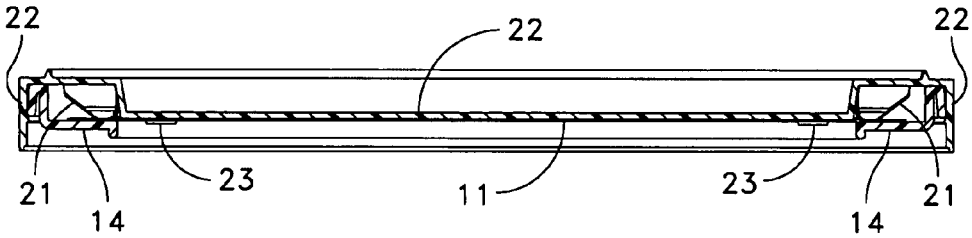
FIG. 11 is a cross-section of a cap showing a moisture impervious layer attached to a lid, through rivets, and with fins attaching loose edges of a moisture impervious material layer to the lid and with the moisture impervious layer material sealed against a fixed surface.

FIG. 11 shows lid 22 with attached fins 21, rivets 23 moisture impervious layer 11 and section of a container top with fixed surface 14 against which moisture impervious layer 11 is sealed.

Figure 12:
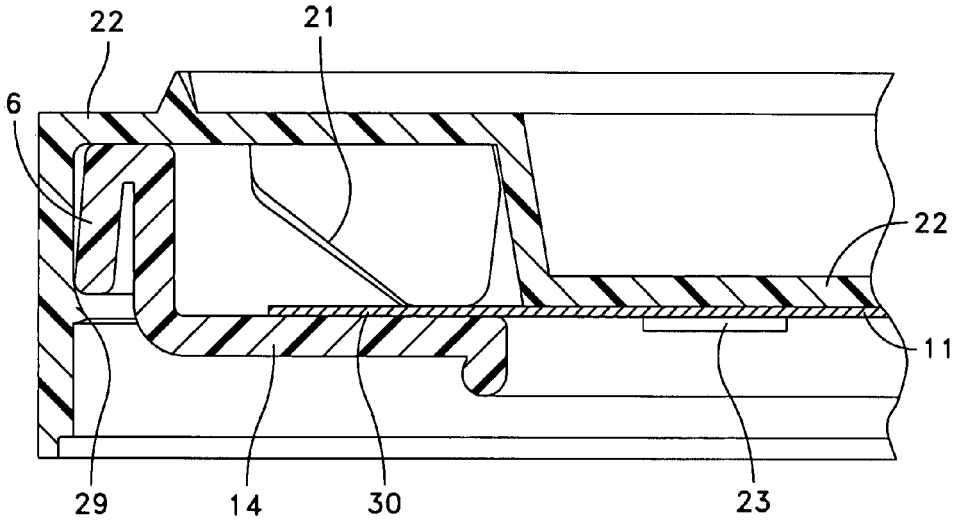
FIG. 12 is an enlarged cross-section of a cap showing a moisture impervious surface attached to a lid, through rivets, and with fins attaching the loose edges of the moisture impervious layer to the lid which is sealed against a fixed surface.
Figure 13:
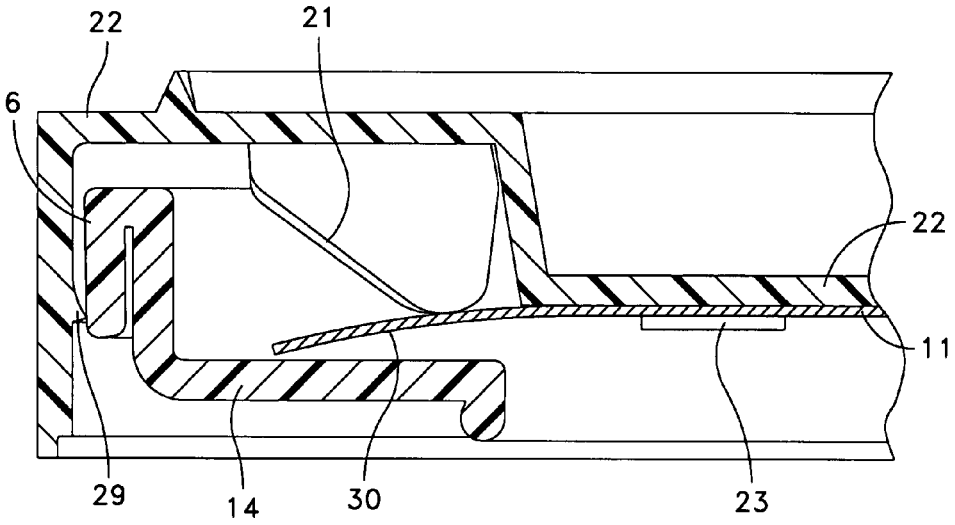
FIG. 13 is an enlarged cross-section of a cap showing a moisture impervious surface attached to a lid, through rivets, and with fins attaching the loose edges of the moisture impervious material layer to the lid which is not sealed against a fixed surface.
Figure 14:
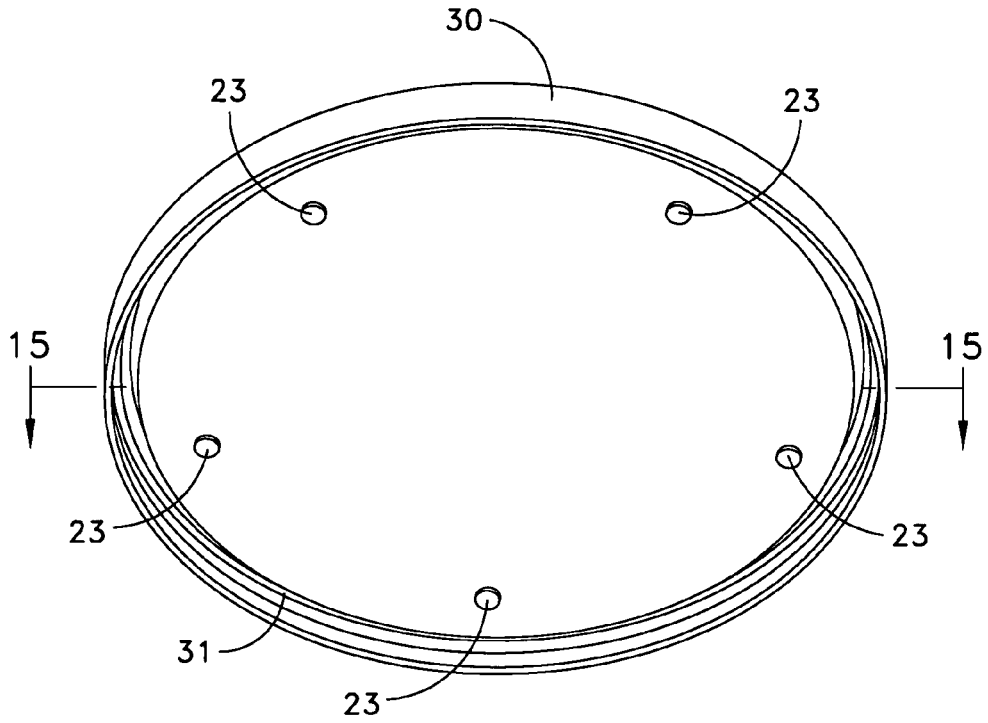
FIG. 14 is an isometric view of the underside of a cap with rivets holding a moisture impervious layer onto a lid and with a raised ring in lid.
Figure 15:
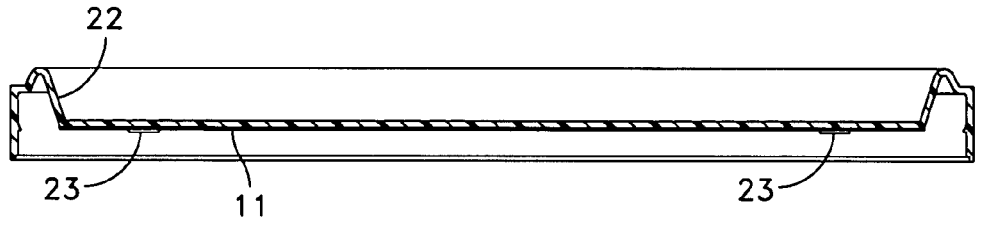
FIG. 15 is a cross-section of cap showing rivets that hold a moisture impervious layer onto a lid with a raised ring in the lid.
Figure 16:
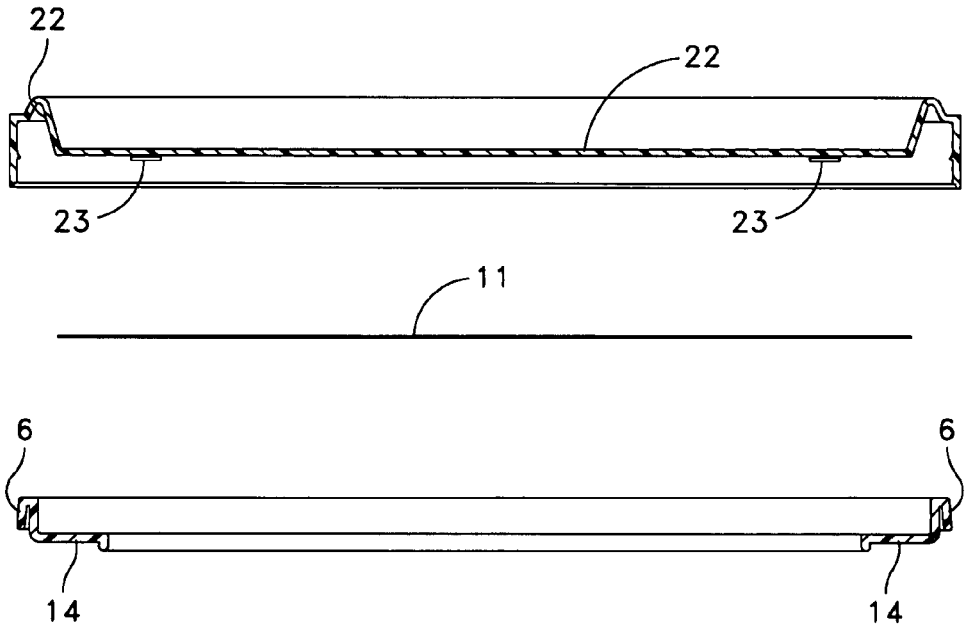
FIG. 16 is an exploded cross-section of a cap showing a lid with rivets and moisture impervious layer with a raised ring in the lid.

FIGS. 12 and 13 are cross-sections of cap 20 showing a moisture impervious layer 11 attached to lid 22, through rivets 23, and with fin 21 attaching the loose edges 30 of moisture impervious layer 11 to lid 22. In FIG. 12 cap 20 is snapped on so that moisture impervious layer 11 is sealed against fixed surface 14. In FIG. 13 cap 20 is not snapped on so that loose edge 30 of moisture impervious layer 11 is not sealed against fixed surface 14. When cap 20 is snapped on, the inward protrusion 29 from lid 22 is underneath the downwardly extending portion of lip 6 of the container. When cap 20 is not fully snapped on, the inward protrusion 29 from lid 22 is not underneath lip 6.

Figure 17:
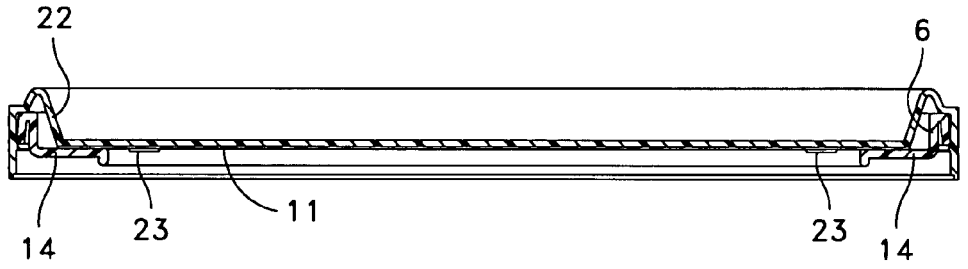
FIG. 17 is a cross-section of a cap showing a moisture impervious surface attached to a lid, through rivets.
Figure 18:
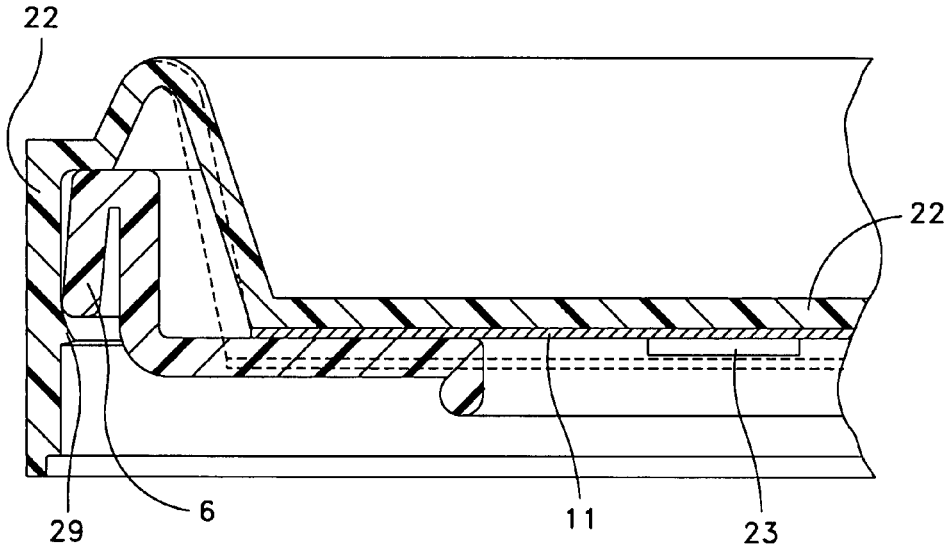
FIG. 18 is an enlarged cross-section of a cap showing a moisture impervious layer attached to a lid, through rivets, with a raised ring in the lid and moisture impervious layer sealed against a fixed surface.
Figure 19:
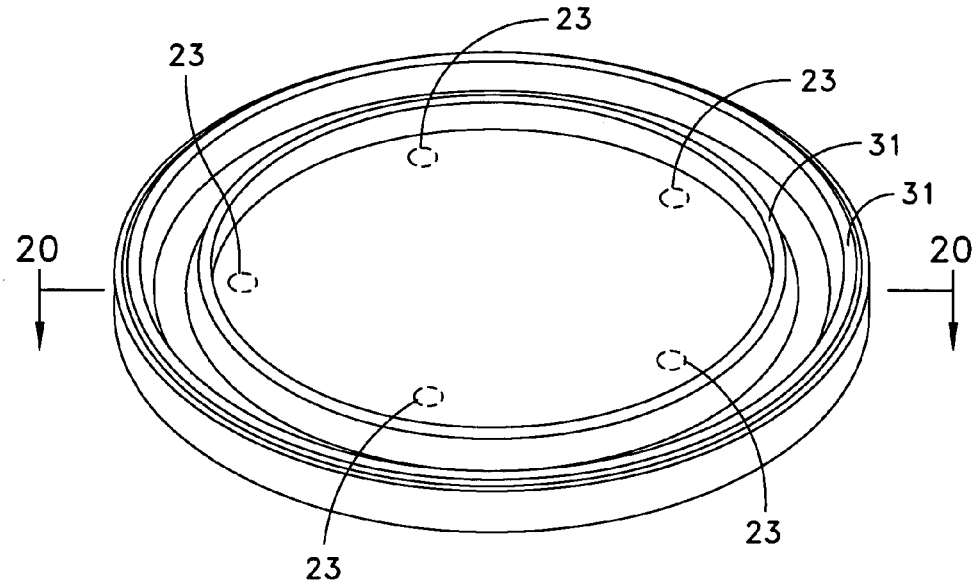
FIG. 19 is an isometric view of the underside of a lid with two raised rings in the lid.
Figure 20:
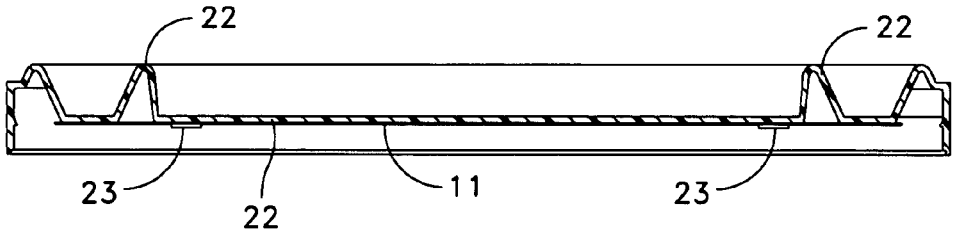
FIG. 20 is a cross-section of a lid with two raised rings in the lid.
Figure 21:
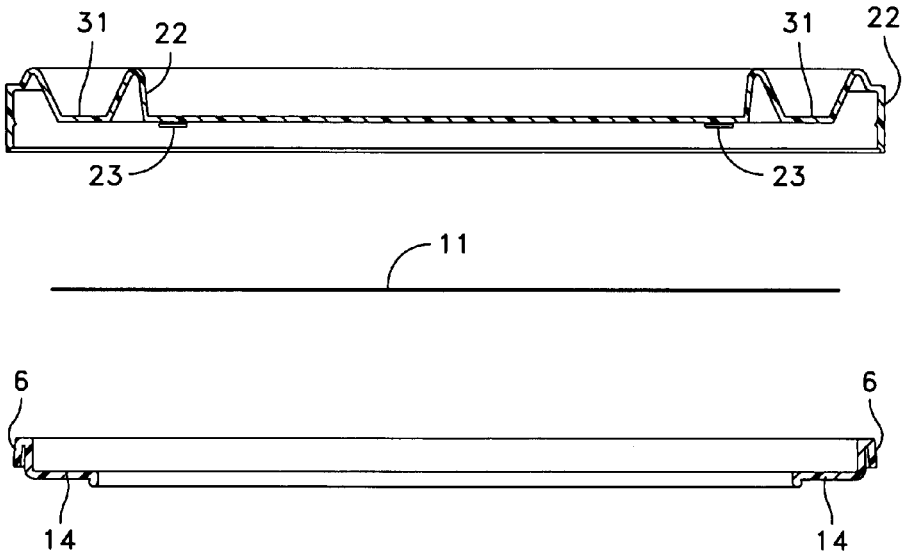
FIG. 21 is an exploded cross-section of a cap with moisture impervious layer and two raised rings.
Figure 22:
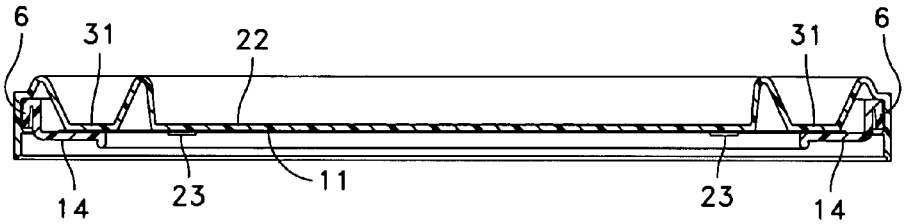
FIG. 22 is a cross-section of a cap with two raised rings and moisture impervious layer sealed against a fixed surface.
Figure 23:
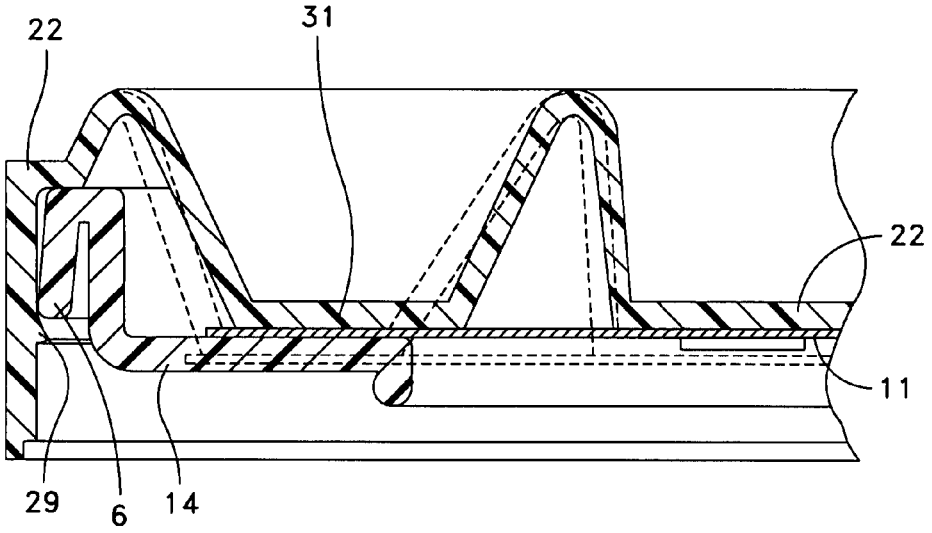
FIG. 23 is an enlarged cross-section of a cap with two raised rings and moisture impervious layer sealed against a fixed surface.

FIGS. 14-18 show an alternative embodiment including lid 30 with rivets 23 for holding a moisture impervious layer 11 onto lid 30 and with raised ring 31 in lid 30. In FIGS. 17 and 18 the moisture impervious layer 24 is shown sealed against a top container surface 15. FIG. 18 shows a dotted line where moisture impervious layer 11 would be if fixed surface 14 where not present. Fixed surface 14 restricts the downward movement of moisture impervious layer 11 and, therefore, creates a moisture barrier when the cap is snapped on and inward protrusion 29 of lid 22 is underneath lip 6.

FIGS. 19-23 are similar to FIGS. 14-18 with the difference being the addition of a second raised ring. Raised rings 31 protrude out from the bottom side of lid 22. Raised rings 31 can be used to seal moisture impervious layer 11 against fixed surface 14.

Example 1

The data in the following table demonstrates the moisture barrier properties provided by the gasketed cap. The extent of moisture leakage into the container was determined by an increase in weight of the container over time. D1 through D24 represent testing days. D1 is the first testing day. Due to a weekend, the next testing day is D4. Testing conditions were 37 degrees C. and 75% relative humidity. 100 test strips were in each can along with 3×7 gram packs of silica gel desiccant. Weights are in grams with a margin of error of 0.1 grams.

C1 through C6 are cans 1 through can 6. All cans include a container and cap. The container was a 401×411 (one end on) composite of a vinyl slip coat/foil/kraft inner liner ply, heat sealed; two plies of can board and a water based acrylic/foil/kraft label as the outer ply. The bottom end was closed by rolled, seamed and crimped steel. The top end was sealed with 401 ULTRASEAL. Height of the can without gasketed cover or closed bottom end was approximately 4.688". C1 and C2 were tested with the peelable metal ULTRASEAL in tact. C3 had the ULTRASEAL removed so that the gasketed cap provided all the moisture tightness. In C4 the gasketed cap was purposefully not fully secured providing a moisture leak control. C5 and C6 had the ULTRASEAL partially in tact so that when the gasketed cap was placed on the can the ULTRASEAL potentially provided another moisture barrier. For C5 the gasketed cap was, as with C4, purposefully not fully secured. In C6 the gasketed cap was fully secured. The data for C1, C2, C3 and C6 show that the gasketed cap provided significant moisture barrier protection that was similar to a fully sealed container. That is, the results for the gasketed cap container with the ULTRASEAL removed (C3) was substantially the same as results with the ULTRASEAL not removed (C1&C2) and C1, C2 and C3 were significantly better than C4. C6 similarly showed significant moisture protection from the gasketed cap as compared to both C5 (cap not fully seated) and C1, C2 (ULTRASEAL intact) and C3 (ULTRASEAL removed so gasket only).

The last row of table 1 shows the change (delta sign) in weight from D1 to D24.

| | C1 | C2 | C3 | C4 | C5 | C6 |
|---|---|---|---|---|---|---|
| D1 | 202.9 | 202.2 | 201.1 | 201.0 | 202.7 | 202.0 |
| D4 | 202.8 | 202.3 | 201.0 | 201.0 | 204.5 | 202.0 |
| D5 | 202.8 | 202.3 | 201.0 | 201.1 | 204.5 | 202.0 |
| D6 | 202.8 | 202.3 | 201.1 | 201.2 | 204.5 | 202.0 |
| D7 | 202.8 | 202.3 | 201.1 | 201.2 | 204.6 | 202.1 |
| D8 | 202.8 | 202.3 | 201.1 | 201.2 | 204.6 | 202.1 |
| D9 | 202.8 | 202.3 | 201.1 | 201.3 | 204.6 | 202.1 |
| D10 | 202.9 | 202.3 | 201.1 | 201.4 | 204.6 | 202.1 |
| D11 | 202.9 | 202.3 | 201.2 | 201.5 | 204.6 | 202.1 |
| D13 | 202.9 | 202.3 | 201.2 | 201.5 | 204.6 | 202.1 |
| D16 | 202.9 | 202.3 | 201.3 | 201.6 | 204.7 | 202.2 |
| D17 | 202.9 | 202.3 | 201.3 | 201.7 | 204.7 | 202.2 |
| D18 | 202.9 | 202.3 | 201.3 | 201.8 | 204.7 | 202.2 |
| D19 | 202.9 | 202.3 | 201.3 | 201.8 | 204.7 | 202.2 |
| D20 | 202.9 | 202.3 | 201.4 | 201.8 | 204.7 | 202.2 |
| D23 | 202.9 | 202.3 | 201.4 | 202.0 | 204.7 | 202.3 |
| D24 | 202.9 | 202.4 | 201.4 | 202.1 | 204.7 | 202.3 |
| Δ | 0 | +0.2 | +0.3 | +1.1 | +2.0 | +0.3 |

Example 2

The data in the following table demonstrates the moisture barrier (low moisture vapor transmission rate) provided by the gasketed cap during more than four months held at 37 degrees C. and 75% relative humidity. The amount of moisture leakage into the container was determined by an increase in weight of the container over time. Weights are in grams.

Can #1 and Can #2 were SONOCO (SONOCO is a registered trademark of Sonoco Products Company, Hartsville, S.C.) cans with a PORON Microcellular Urethane foam gasket, ALCOA COLDFORM 3000 moisture impervious layer and plastic lid. The cans also included three 7 gram containers of desiccant. The cans were nitrogen purged for 15 seconds before sealing with foil. The container was a 401×411 (one end on) composite of a vinyl slip coat/foil/kraft inner liner ply, heat sealed; two plies of Can Board and a water based acrylic/foil/kraft label as the outer ply. The bottom end was closed by rolled, seamed and crimped steel. The top end was sealed with ULTRASEAL. Height of the can without gasketed cover or closed bottom end was approximately 4.688"C1 and C2 were tested with the peelable metal ULTRASEAL in tact. Can #3 and Can #4 were the same as Can #1 and Can #2 except that the ULTRASEAL was removed so that the gasketed cap provided the moisture barrier.

Can #5 and Can #6 were SNAPWARE (SNAPWARE is a registered trademark of SnapWare Corporation, Mira Loma, Calif.) cans with heat sealed top and stored in zip-lock bags. Can #7 and Can #8 were the same as Can #5 and Can #6 except that the Heat Seal was removed. Data was collected during the time period of Sep. 29, 2006, through Feb. 2, 2007. The results demonstrate that the cans with the foam gasket and moisture impervious layer (C1, C2, C3 and C4) provided a better moisture barrier, as shown by the reduced weight increase, as compared to containers lacking the gasket and moisture impervious layer (C5, C6, C7 and C8).

The following Table 1 shows the data generated from Can #1. The increase in weight was 0.2 grams.

| Date | Data |
|---|---|
| 9-29 | 202.9 |
| 10-2 | 202.8 |
| 10-3 | 202.8 |
| 10-4 | 202.8 |
| 10-5 | 202.8 |
| 10-6 | 202.8 |
| 10-9 | 202.8 |
| 10-10 | 202.9 |
| 10-11 | 202.9 |
| 10-13 | 202.9 |
| 10-16 | 202.9 |
| 10-17 | 202.9 |
| 10-18 | 202.9 |
| 10-19 | 202.9 |
| 10-20 | 202.9 |
| 10-23 | 202.9 |
| 10-24 | 202.9 |
| 10-25 | 202.9 |
| 10-26 | 202.9 |
| 10-27 | 202.9 |
| 10-30 | 202.9 |
| 10-31 | 203.0 |
| 11-01 | 203.0 |
| 11-02 | 203.0 |
| 11-03 | 203.0 |
| 11-06 | 203.1 |
| 11-07 | 203.1 |
| 11-08 | 203.1 |
| 11-09 | 203.1 |
| 11-10 | 203.1 |
| 11-13 | 203.1 |
| 11-14 | 203.1 |
| 11-15 | 203.2 |
| 11-16 | 203.2 |
| 11-17 | 203.2 |
| 11-20 | 203.2 |
| 11-21 | 203.2 |
| 11-22 | 203.2 |
| 11-27 | 202.9 |
| 11-28 | 203.0 |
| 11-29 | 203.0 |
| 11-30 | 203.0 |
| 12-1 | 203.0 |
| 12-4 | 203.0 |
| 12-5 | 203.0 |
| 12-6 | 203.0 |
| 12-7 | 203.0 |
| 12-8 | 203.0 |
| 12-11 | 202.9 |
| 12-12 | 203.0 |
| 12-13 | 203.0 |
| 12-14 | 203.0 |
| 12-15 | 203.0 |
| 12-18 | 203.0 |
| 12-19 | 203.0 |
| 12-20 | 203.0 |
| 12-21 | 203.1 |
| 12-26 | 203.0 |
| 12-27 | 203.0 |
| 12-28 | 203.0 |
| 12-29 | 203.0 |
| 1-2 | 203.0 |
| 1-3 | 203.0 |
| 1-4 | 203.0 |
| 1-5 | 203.0 |
| 1-8 | 203.0 |
| 1-9 | 203.0 |

-continued

| Date | Data |
|---|---|
| 1-10 | 203.1 |
| 1-11 | 203.1 |
| 1-12 | 203.1 |
| 1-15 | 203.0 |
| 1-16 | 203.0 |
| 1-17 | 203.0 |
| 1-18 | 203.0 |
| 1-19 | 203.1 |
| 1-22 | 203.0 |
| 1-24 | 203.1 |
| 1-25 | 203.1 |
| 1-26 | 203.1 |
| 1-29 | 203.1 |
| 1-30 | 203.1 |
| 1-31 | 203.0 |
| 2-1 | 203.1 |
| 2-2 | 203.1 |

The following Table 2 shows the data generated from Can #2. The increase in weight was 0.3 grams.

| Date | Data |
|---|---|
| 9-29 | 202.2 |
| 10-2 | 202.3 |
| 10-3 | 202.3 |
| 10-4 | 202.3 |
| 10-5 | 202.3 |
| 10-6 | 202.3 |
| 10-9 | 202.3 |
| 10-10 | 202.3 |
| 10-11 | 202.3 |
| 10-13 | 202.3 |
| 10-16 | 202.3 |
| 10-17 | 202.3 |
| 10-18 | 202.3 |
| 10-19 | 202.3 |
| 10-20 | 202.3 |
| 10-23 | 202.3 |
| 10-24 | 202.4 |
| 10-25 | 202.3 |
| 10-26 | 202.3 |
| 10-27 | 202.3 |
| 10-30 | 202.4 |
| 10-31 | 202.4 |
| 11-01 | 202.4 |
| 11-02 | 202.4 |
| 11-03 | 202.4 |
| 11-06 | 202.4 |
| 11-07 | 202.4 |
| 11-08 | 202.5 |
| 11-09 | 202.5 |
| 11-10 | 202.5 |
| 11-13 | 202.5 |
| 11-14 | 202.5 |
| 11-15 | 202.5 |
| 11-16 | 202.5 |
| 11-17 | 202.7 |
| 11-20 | 202.7 |
| 11-21 | 202.7 |
| 11-22 | 202.4 |
| 11-27 | 202.4 |
| 11-28 | 202.4 |
| 11-29 | 202.4 |
| 11-30 | 202.4 |
| 12-1 | 202.4 |
| 12-4 | 202.4 |
| 12-5 | 202.4 |
| 12-6 | 202.4 |
| 12-7 | 202.4 |
| 12-8 | 202.4 |
| 12-11 | 202.4 |
| 12-12 | 202.4 |
| 12-13 | 202.4 |
| 12-14 | 202.4 |

-continued

| Date | Data |
|---|---|
| 12-15 | 202.4 |
| 12-18 | 202.4 |
| 12-19 | 202.4 |
| 12-20 | 202.4 |
| 12-21 | 202.4 |
| 12-26 | 202.4 |
| 12-27 | 202.4 |
| 12-28 | 202.4 |
| 12-29 | 202.4 |
| 1-2 | 202.4 |
| 1-3 | 202.4 |
| 1-4 | 202.4 |
| 1-5 | 202.4 |
| 1-8 | 202.4 |
| 1-9 | 202.4 |
| 1-10 | 202.4 |
| 1-11 | 202.4 |
| 1-12 | 202.4 |
| 1-15 | 202.4 |
| 1-16 | 202.4 |
| 1-17 | 202.4 |
| 1-18 | 202.4 |
| 1-19 | 202.4 |
| 1-22 | 202.4 |
| 1-24 | 202.4 |
| 1-25 | 202.4 |
| 1-26 | 202.4 |
| 1-29 | 202.4 |
| 1-30 | 202.4 |
| 1-31 | 202.4 |
| 2-1 | 202.4 |
| 2-2 | 202.5 |

The following Table 3 shows the data generated from Can #3. The increase in weight was 1.7 grams.

| Date | Data |
|---|---|
| 9-29 | 201.1 |
| 10-2 | 201.0 |
| 10-3 | 201.0 |
| 10-4 | 201.1 |
| 10-5 | 201.1 |
| 10-6 | 201.1 |
| 10-9 | 201.1 |
| 10-10 | 201.1 |
| 10-11 | 201.2 |
| 10-13 | 201.2 |
| 10-16 | 201.3 |
| 10-17 | 201.3 |
| 10-18 | 201.3 |
| 10-19 | 201.3 |
| 10-20 | 201.4 |
| 10-23 | 201.4 |
| 10-24 | 201.4 |
| 10-25 | 201.4 |
| 10-26 | 201.4 |
| 10-27 | 201.4 |
| 10-30 | 201.5 |
| 10-31 | 201.5 |
| 11-01 | 201.5 |
| 11-02 | 201.6 |
| 11-03 | 201.6 |
| 11-06 | 201.7 |
| 11-07 | 201.7 |
| 11-08 | 201.7 |
| 11-09 | 201.7 |
| 11-10 | 201.7 |
| 11-13 | 201.8 |
| 11-14 | 201.8 |
| 11-15 | 201.8 |
| 11-16 | 201.8 |
| 11-17 | 201.8 |
| 11-20 | 201.8 |
| 11-21 | 201.8 |

-continued

| Date | Data |
|---|---|
| 11-22 | 201.9 |
| 11-27 | 201.9 |
| 11-28 | 201.9 |
| 11-29 | 201.9 |
| 11-30 | 201.9 |
| 12-1 | 201.9 |
| 12-4 | 202.0 |
| 12-5 | 202.0 |
| 12-6 | 202.1 |
| 12-7 | 202.1 |
| 12-8 | 202.1 |
| 12-11 | 202.1 |
| 12-12 | 202.1 |
| 12-13 | 202.2 |
| 12-14 | 202.2 |
| 12-15 | 202.2 |
| 12-18 | 202.3 |
| 12-19 | 202.3 |
| 12-20 | 202.3 |
| 12-21 | 202.3 |
| 12-26 | 202.4 |
| 12-27 | 202.4 |
| 12-28 | 202.4 |
| 12-29 | 202.4 |
| 1-2 | 202.4 |
| 1-3 | 202.4 |
| 1-4 | 202.5 |
| 1-5 | 202.5 |
| 1-8 | 202.5 |
| 1-9 | 202.5 |
| 1-10 | 202.6 |
| 1-11 | 202.6 |
| 1-12 | 202.6 |
| 1-15 | 202.6 |
| 1-16 | 202.6 |
| 1-17 | 202.6 |
| 1-18 | 202.6 |
| 1-19 | 202.6 |
| 1-22 | 202.7 |
| 1-24 | 202.7 |
| 1-25 | 202.7 |
| 1-26 | 202.7 |
| 1-29 | 202.7 |
| 1-30 | 202.7 |
| 1-31 | 202.8 |
| 2-1 | 202.8 |
| 2-2 | 202.8 |

The following Table 4 shows the data generated from Can #4. The increase in weight was 1.7 grams.

| Date | Data |
|---|---|
| 9-29 | 202.0 |
| 10-2 | 202.0 |
| 10-3 | 202.0 |
| 10-4 | 202.0 |
| 10-5 | 202.1 |
| 10-6 | 202.1 |
| 10-9 | 202.1 |
| 10-10 | 202.1 |
| 10-11 | 202.1 |
| 10-13 | 202.1 |
| 10-16 | 202.2 |
| 10-17 | 202.2 |
| 10-18 | 202.2 |
| 10-19 | 202.2 |
| 10-20 | 202.2 |
| 10-23 | 202.3 |
| 10-24 | 202.3 |
| 10-25 | 202.3 |
| 10-26 | 202.3 |
| 10-27 | 202.3 |
| 10-30 | 202.4 |
| 10-31 | 202.4 |

-continued

| Date | Data |
|---|---|
| 11-01 | 202.4 |
| 11-02 | 202.4 |
| 11-03 | 202.4 |
| 11-06 | 202.5 |
| 11-07 | 202.5 |
| 11-08 | 202.6 |
| 11-09 | 202.6 |
| 11-10 | 202.6 |
| 11-13 | 202.6 |
| 11-14 | 202.6 |
| 11-15 | 202.6 |
| 11-16 | 202.6 |
| 11-17 | 202.7 |
| 11-20 | 202.7 |
| 11-21 | 202.7 |
| 11-22 | 202.7 |
| 11-27 | 202.8 |
| 11-28 | 202.8 |
| 11-29 | 202.8 |
| 11-30 | 202.8 |
| 12-1 | 202.9 |
| 12-4 | 202.9 |
| 12-5 | 202.9 |
| 12-6 | 202.9 |
| 12-7 | 202.9 |
| 12-8 | 203.0 |
| 12-11 | 203.0 |
| 12-12 | 203.0 |
| 12-13 | 203.1 |
| 12-14 | 203.1 |
| 12-15 | 203.1 |
| 12-18 | 203.1 |
| 12-19 | 203.1 |
| 12-20 | 203.1 |
| 12-21 | 203.2 |
| 12-26 | 203.3 |
| 12-27 | 203.3 |
| 12-28 | 203.3 |
| 12-29 | 203.2 |
| 1-2 | 203.3 |
| 1-3 | 203.4 |
| 1-4 | 203.4 |
| 1-5 | 203.4 |
| 1-8 | 203.4 |
| 1-9 | 203.4 |
| 1-10 | 203.4 |
| 1-11 | 203.4 |
| 1-12 | 203.5 |
| 1-15 | 203.5 |
| 1-16 | 203.5 |
| 1-17 | 203.5 |
| 1-18 | 203.8 |
| 1-19 | 203.8 |
| 1-22 | 203.6 |
| 1-24 | 203.6 |
| 1-25 | 203.6 |
| 1-26 | 203.6 |
| 1-29 | 203.6 |
| 1-30 | 203.6 |
| 1-31 | 203.6 |
| 2-1 | 203.7 |
| 2-2 | 203.7 |

The following Table 5 shows the data generated from Can #5. The increase in weight was 3.8 grams.

| Date | Data |
|---|---|
| 9-29 | 263.3 |
| 10-2 | 263.1 |
| 10-3 | 263.2 |
| 10-4 | 263.3 |
| 10-5 | 263.3 |
| 10-6 | 263.3 |
| 10-9 | 263.4 |
| 10-10 | 263.5 |
| 10-11 | 263.5 |

-continued

| Date | Data |
|---|---|
| 10-13 | 263.5 |
| 10-16 | 263.6 |
| 10-17 | 263.6 |
| 10-18 | 263.7 |
| 10-19 | 263.7 |
| 10-20 | 263.8 |
| 10-23 | 263.8 |
| 10-24 | 263.9 |
| 10-25 | 263.9 |
| 10-26 | 263.9 |
| 10-27 | 264.0 |
| 10-30 | 264.1 |
| 10-31 | 264.2 |
| 11-01 | 264.2 |
| 11-02 | 264.2 |
| 11-03 | 264.2 |
| 11-06 | 264.3 |
| 11-07 | 264.4 |
| 11-08 | 264.5 |
| 11-09 | 264.5 |
| 11-10 | 264.5 |
| 11-13 | 264.7 |
| 11-14 | 264.7 |
| 11-15 | 265.1 |
| 11-16 | 265.1 |
| 11-17 | 265.1 |
| 11-20 | 265.2 |
| 11-21 | 265.2 |
| 11-22 | 265.2 |
| 11-27 | 265.4 |
| 11-28 | 265.4 |
| 11-29 | 265.5 |
| 11-30 | 265.5 |
| 12-1 | 265.5 |
| 12-4 | 265.9 |
| 12-5 | 265.9 |
| 12-6 | 265.9 |
| 12-7 | 265.9 |
| 12-8 | 265.9 |
| 12-11 | 266 |
| 12-12 | 266 |
| 12-13 | 266.3 |
| 12-14 | 266.2 |
| 12-15 | 266.2 |
| 12-18 | 266.4 |
| 12-19 | 266.4 |
| 12-20 | 266.4 |
| 12-21 | 266.5 |
| 12-26 | 266.6 |
| 12-27 | 266.6 |
| 12-28 | 266.5 |
| 12-29 | 266.6 |
| 1-2 | 267.3 |
| 1-3 | 267.9 |
| 1-4 | 267.9 |
| 1-5 | 267.9 |
| 1-8 | 266.8 |
| 1-9 | 266.8 |
| 1-10 | 267 |
| 1-11 | 267.1 |
| 1-12 | 267.2 |
| 1-15 | 266.9 |
| 1-16 | 266.9 |
| 1-17 | 266.9 |
| 1-18 | 266.9 |
| 1-19 | 266.9 |
| 1-22 | 266.9 |
| 1-24 | 267.1 |
| 1-25 | 267.1 |
| 1-26 | 267.1 |
| 1-29 | 267.1 |
| 1-30 | 267.1 |
| 1-31 | 267.1 |
| 2-1 | 267.1 |
| 2-2 | 267.1 |

The following Table 6 shows the data generated from Can #6. The increase in weight was 3.8 grams.

| Date | Data |
|---|---|
| 9-29 | 262.2 |
| 10-2 | 262.1 |
| 10-3 | 262.1 |
| 10-4 | 262.1 |
| 10-5 | 262.1 |
| 10-6 | 262.2 |
| 10-9 | 262.2 |
| 10-10 | 262.3 |
| 10-11 | 262.3 |
| 10-13 | 262.4 |
| 10-16 | 262.4 |
| 10-17 | 262.4 |
| 10-18 | 262.4 |
| 10-19 | 262.5 |
| 10-20 | 262.5 |
| 10-23 | 262.6 |
| 10-24 | 262.6 |
| 10-25 | 262.7 |
| 10-26 | 262.7 |
| 10-27 | 262.7 |
| 10-30 | 262.8 |
| 10-31 | 262.8 |
| 11-01 | 262.8 |
| 11-02 | 262.8 |
| 11-03 | 262.9 |
| 11-06 | 262.9 |
| 11-07 | 263.0 |
| 11-08 | 263.1 |
| 11-09 | 263.1 |
| 11-10 | 263.2 |
| 11-13 | 263.2 |
| 11-14 | 263.2 |
| 11-15 | 263.3 |
| 11-16 | 263.3 |
| 11-17 | 263.3 |
| 11-20 | 263.5 |
| 11-21 | 263.5 |
| 11-22 | 263.5 |
| 11-27 | 263.9 |
| 11-28 | 264.0 |
| 11-29 | 264.0 |
| 11-30 | 264.0 |
| 12-1 | 264.0 |
| 12-4 | 264.1 |
| 12-5 | 264.3 |
| 12-6 | 264.3 |
| 12-7 | 264.3 |
| 12-8 | 264.4 |
| 12-11 | 264.5 |
| 12-12 | 264.6 |
| 12-13 | 264.7 |
| 12-14 | 264.9 |
| 12-15 | 264.9 |
| 12-18 | 264.9 |
| 12-19 | 265.1 |
| 12-20 | 265.1 |
| 12-21 | 265.2 |
| 12-26 | 265.6 |
| 12-27 | 265.2 |
| 12-28 | 265.2 |
| 12-29 | 265.6 |
| 1-2 | 265.6 |
| 1-3 | 265.6 |
| 1-4 | 265.6 |
| 1-5 | 265.7 |
| 1-8 | 265.6 |
| 1-9 | 265.6 |
| 1-10 | 265.8 |
| 1-11 | 265.8 |
| 1-12 | 265.7 |
| 1-15 | 265.7 |
| 1-16 | 265.7 |
| 1-17 | 265.7 |
| 1-18 | 265.8 |
| 1-19 | 265.9 |

-continued

| Date | Data |
|---|---|
| 1-22 | 265.8 |
| 1-24 | 265.9 |
| 1-25 | 265.9 |
| 1-26 | 265.9 |
| 1-29 | 266.6 |
| 1-30 | 266.7 |
| 1-31 | 266.2 |
| 2-1 | 266 |
| 2-2 | 266 |

The following Table 7 shows the data generated from Can #7. The increase in weight was 4.0 grams.

| Date | Data |
|---|---|
| 9-29 | 263.0 |
| 10-2 | 262.7 |
| 10-3 | 262.8 |
| 10-4 | 262.8 |
| 10-5 | 262.9 |
| 10-6 | 263.0 |
| 10-9 | 263.0 |
| 10-10 | 263.0 |
| 10-11 | 263.1 |
| 10-13 | 263.1 |
| 10-16 | 263.4 |
| 10-17 | 263.4 |
| 10-18 | 263.5 |
| 10-19 | 263.5 |
| 10-20 | 263.6 |
| 10-23 | 263.8 |
| 10-24 | 263.9 |
| 10-25 | 264.0 |
| 10-26 | 264.1 |
| 10-27 | 264.1 |
| 10-30 | 264.4 |
| 10-31 | 264.4 |
| 11-01 | 264.5 |
| 11-02 | 264.5 |
| 11-03 | 264.7 |
| 11-06 | 264.8 |
| 11-07 | 265.0 |
| 11-08 | 265.1 |
| 11-09 | 265.2 |
| 11-10 | 265.2 |
| 11-13 | 265.7 |
| 11-14 | 265.7 |
| 11-15 | 265.8 |
| 11-16 | 265.8 |
| 11-17 | 265.8 |
| 11-20 | 265.8 |
| 11-21 | 265.8 |
| 11-22 | 265.8 |
| 11-27 | 266.1 |
| 11-28 | 266.3 |
| 11-29 | 266.3 |
| 11-30 | 266.3 |
| 12-1 | 266.3 |
| 12-4 | 266.3 |
| 12-5 | 266.3 |
| 12-6 | 266.3 |
| 12-7 | 266.3 |
| 12-8 | 266.3 |
| 12-11 | 266.3 |
| 12-12 | 266.4 |
| 12-13 | 266.5 |
| 12-14 | 266.7 |
| 12-15 | 266.7 |
| 12-18 | 266.7 |
| 12-19 | 266.7 |
| 12-20 | 266.7 |
| 12-21 | 266.6 |
| 12-26 | 266.6 |
| 12-27 | 266.6 |
| 12-28 | 266.7 |

-continued

| Date | Data |
|---|---|
| 12-29 | 267 |
| 1-2 | 267.0 |
| 1-3 | 266.8 |
| 1-4 | 266.8 |
| 1-5 | 266.9 |
| 1-8 | 266.8 |
| 1-9 | 266.8 |
| 1-10 | 267.4 |
| 1-11 | 267.2 |
| 1-12 | 267.1 |
| 1-15 | 266.9 |
| 1-16 | 266.8 |
| 1-17 | 267.2 |
| 1-18 | 266.9 |
| 1-19 | 266.8 |
| 1-22 | 266.8 |
| 1-24 | 267 |
| 1-25 | 267 |
| 1-26 | 267 |
| 1-29 | 267.6 |
| 1-30 | 267.6 |
| 1-31 | 266.9 |
| 2-1 | 267 |
| 2-2 | 267 |

The following Table 8 shows the data generated from Can #8. The increase in weight was 5.3 grams.

| Date | Data |
|---|---|
| 9-29 | 262.5 |
| 10-2 | 262.4 |
| 10-3 | 262.4 |
| 10-4 | 262.4 |
| 10-5 | 262.5 |
| 10-6 | 262.5 |
| 10-9 | 262.6 |
| 10-10 | 262.6 |
| 10-11 | 262.7 |
| 10-13 | 262.9 |
| 10-16 | 263.0 |
| 10-17 | 263.1 |
| 10-18 | 263.2 |
| 10-19 | 263.2 |
| 10-20 | 263.3 |
| 10-23 | 263.4 |
| 10-24 | 263.6 |
| 10-25 | 263.7 |
| 10-26 | 263.8 |
| 10-27 | 263.8 |
| 10-30 | 264.1 |
| 10-31 | 264.2 |
| 11-01 | 264.3 |
| 11-02 | 264.3 |
| 11-03 | 264.5 |
| 11-06 | 264.6 |
| 11-07 | 264.7 |
| 11-08 | 264.9 |
| 11-09 | 265.0 |
| 11-10 | 265.0 |
| 11-13 | 265.3 |
| 11-14 | 265.3 |
| 11-15 | 265.3 |
| 11-16 | 265.3 |
| 11-17 | 265.5 |
| 11-20 | 265.6 |
| 11-21 | 265.6 |
| 11-22 | 265.6 |
| 11-27 | 266.3 |
| 11-28 | 266.3 |
| 11-29 | 266.3 |
| 11-30 | 266.3 |
| 12-1 | 266.3 |
| 12-4 | 266.4 |
| 12-5 | 266.4 |

-continued

| Date | Data |
|---|---|
| 12-6 | 266.4 |
| 12-7 | 266.4 |
| 12-8 | 266.4 |
| 12-11 | 266.4 |
| 12-12 | 266.1 |
| 12-13 | 266.2 |
| 12-14 | 266.2 |
| 12-15 | 266.3 |
| 12-18 | 266.4 |
| 12-19 | 266.4 |
| 12-20 | 266.4 |
| 12-21 | 266.4 |
| 12-26 | 266.7 |
| 12-27 | 266.4 |
| 12-28 | 266.4 |
| 12-29 | 266.5 |
| 1-2 | 266.8 |
| 1-3 | 266.9 |
| 1-4 | 266.9 |
| 1-5 | 267.2 |
| 1-8 | 267 |
| 1-9 | 267 |
| 1-10 | 267.2 |
| 1-11 | 267.2 |
| 1-12 | 267.2 |
| 1-15 | 266.6 |
| 1-16 | 266.6 |
| 1-17 | 267.5 |
| 1-18 | 266.7 |
| 1-19 | 266.9 |
| 1-22 | 267 |
| 1-24 | 266.9 |
| 1-25 | 266.9 |
| 1-26 | 266.9 |
| 1-29 | 266.8 |
| 1-30 | 266.8 |
| 1-31 | 267.7 |
| 2-1 | 267.8 |
| 2-2 | 267.8 |

The invention claimed is:

1. An apparatus for packaging a moisture-sensitive item comprising:

(a) a container, the container having a closed container bottom, a container top, a sidewall, a container opening, wherein the bottom, top, and sidewall define an interior, and at least one fixed surface ledge within the apparatus' container opening and protruding inward from the sidewall within the interior and recessed below the container top, wherein the sidewall extends upwardly from the container bottom to the container top so as to frame the container opening and the fixed surface ledge below the container top and extends inwardly substantially perpendicular from the sidewall of the container so that the container opening is narrowed by the fixed surface ledge; and (b) a cap removable from contact with the fixed surface ledge of the container, the cap having:

(i) a lid, the lid comprising an inside portion and an outside portion, the lid adapted to form a seal with the container top;

(ii) a resilient compressible member, the compressible member is aligning over the fixed surface ledge, and the compressible member protruding parallel beyond the fixed surface ledge in a closed position and having a top and a bottom, the top attached to the inside portion of the lid; and (iii) a moisture impervious layer is aligning over the fixed surface ledge and protruding parallel beyond the fixed surface ledge in a closed position and comprising a metallic foil material attached to the bottom of the compressible member and situated, so when the lid forms a seal with the container top the foil material contacts the fixed surface ledge to form a moisture barrier, wherein the moisture impervious layer exerts a moisture-barrier compression perpendicular to the fixed surface ledge within the container opening when the cap is in the closed position.

2. The apparatus of claim 1 wherein the compressible member comprises a foam or foam-like material.

3. The apparatus of claim 2 wherein the foam-like material comprises a polyurethane foam.

4. The apparatus of claim 3 wherein the polyurethane foam is a quick-recovery, resilient polyurethane foam.

5. The apparatus of claim 1 wherein the compressible member comprises a foam or foam-like material having a low moisture transmission rate.

6. The apparatus of claim 1 wherein the metallic foil material comprises a wrinkle-free foil material.

7. The apparatus of claim 1 wherein the metallic foil material comprises a epoxy coated foil.

8. The apparatus of claim 1 wherein the fixed surface provides a surface against which a removable covering can be attached.

9. The apparatus of claim 1 wherein the container comprises a foiled lined paper composite can.

10. The apparatus of claim 1 wherein the moisture sensitive item comprises a diagnostic test strip.

11. The apparatus of claim 1 wherein the moisture sensitive item comprises a medical device.

12. The apparatus of claim 1 wherein the moisture sensitive item comprises a food.

13. The apparatus of claim 1 wherein the container comprises a desiccant entrained liner.

14. The apparatus of claim 13 wherein the desiccant entrained liner is within the cap.

15. The apparatus of claim 13 wherein the desiccant entrained liner is within the container.

* * * * *